US007568850B2

(12) United States Patent
Bingham et al.

(10) Patent No.: US 7,568,850 B2
(45) Date of Patent: Aug. 4, 2009

(54) MEDIA STACK CONTROL

(75) Inventors: Jeffrey G. Bingham, Vancouver, WA (US); Maxwell S. DeHaven, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 687 days.

(21) Appl. No.: 10/921,577

(22) Filed: Aug. 18, 2004

(65) Prior Publication Data

US 2006/0039734 A1 Feb. 23, 2006

(51) Int. Cl.
*B41J 13/10* (2006.01)
*B65H 1/04* (2006.01)
*B65H 1/08* (2006.01)

(52) U.S. Cl. ..... 400/624; 271/9.08; 271/145

(58) Field of Classification Search ..... 271/157, 271/9.08, 145, 147; 400/624, 625, 622, 693, 400/708, 703; 399/391, 393
See application file for complete search history.

(56) References Cited

U.S. PATENT DOCUMENTS 4,332,375 A * 6/1982 Tsubo ..... 271/9.05
4,418,907 A * 12/1983 Shultz et al. ..... 271/157
RE32,281 E * 11/1986 Tsubo ..... 271/9.11
4,800,400 A 1/1989 Douglas
4,801,135 A * 1/1989 Povio ..... 271/155
4,809,020 A 2/1989 Agulnek
4,830,354 A * 5/1989 Penson ..... 271/147
4,835,573 A 5/1989 Rohrer et al.
5,123,637 A * 6/1992 Musaka ..... 271/117
5,207,416 A * 5/1993 Soler ..... 271/31
5,939,646 A 8/1999 Fowler
5,988,628 A * 11/1999 Mori ..... 271/117
6,102,389 A * 8/2000 Sakurai et al. ..... 271/121
6,123,329 A * 9/2000 Sato et al. ..... 271/9.01
6,293,193 B1 * 9/2001 Bolza-Schunemann ..... 101/229
6,332,609 B1 * 12/2001 Arakawa ..... 271/157
6,350,073 B1 2/2002 McCue, Jr. et al.
6,361,038 B1 * 3/2002 Tada et al. ..... 271/111
6,523,821 B2 * 2/2003 Kashiwagi et al. ..... 271/145
6,729,376 B1 5/2004 Kakinuma et al.
6,757,501 B2 * 6/2004 Mochizuki et al. ..... 399/18
6,806,946 B2 * 10/2004 Otaki ..... 355/407
7,029,006 B2 * 4/2006 Izumi et al. ..... 271/145
7,182,337 B2 * 2/2007 Sasai et al. ..... 271/265.041
2003/0086130 A1 5/2003 Guddanti

FOREIGN PATENT DOCUMENTS

JP 61106374 A * 5/1986

* cited by examiner

*Primary Examiner*—Daniel J Colilla

(57) ABSTRACT

A method is disclosed for raising a base having media thereon. In an example embodiment, the method includes first raising a base having media thereon, ceasing the raising the base upon detecting the media, detecting an absence of the media, and second raising the base upon the detecting the absence of the media.

4 Claims, 3 Drawing Sheets

MEDIA STACK CONTROL

BACKGROUND

Image forming devices, such as printers, copiers, and the like, are used to form images on media. In the past, advancing media from a media stack to a location of image formation has been problematic in some applications. For example, using encoders to control motion of a stack of media may be expensive in some situations. Moreover, use of damper devices in media handling devices may also be expensive to implement in some situations.

DETAILED DESCRIPTION

Figure 1:
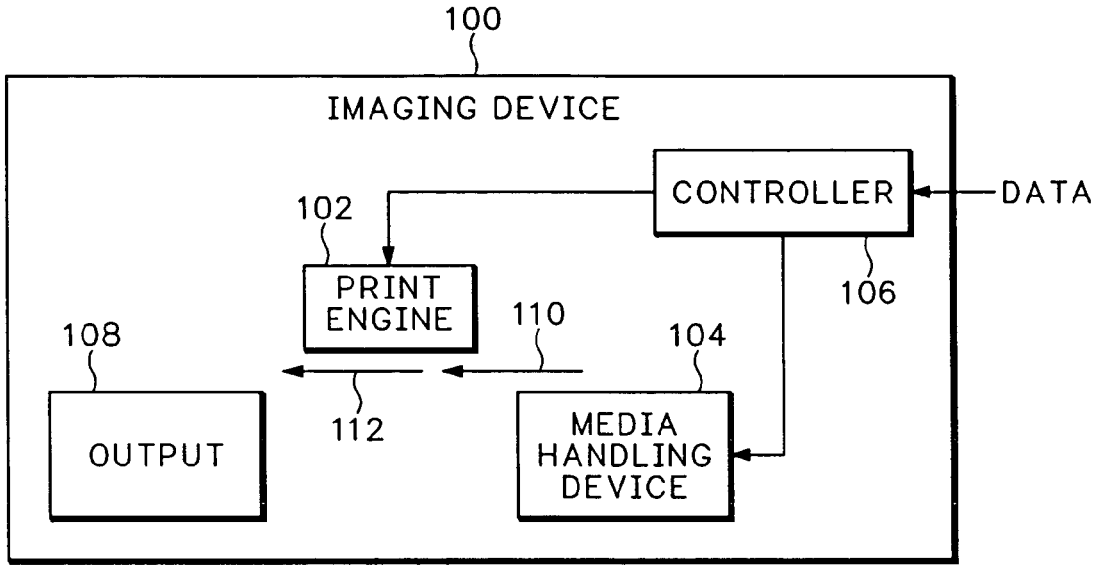
FIG. 1 is a schematic diagram of an example imaging device in accordance with an embodiment.

FIG. 1 schematically illustrates an example embodiment of an imaging device 100. Example embodiments of the imagine device 100 include, but are not limited to, a printer, a copier, a multifunction device, or the like. The imaging device 100 is shown as including a print engine 102, a media handling device 104, a controller 106, and an output 108. In general, the imaging device 100 receives data, such as a print job at the controller 106. The controller 106 then controls the media handling device 104 to advance media 110 to a print zone 112 adjacent the print engine 102. The controller 106 may also control the print engine 102 to image the media 110. The media 110 may then be advanced, such as by rollers (not shown), to the output 108, such as an output tray.

The print engine 102 may be an ink jet print engine, an electrostatic print engine, or any other suitable print engine. The print engine 102 may be generally controlled by the controller 106 to form images on the media 110.

The controller 106 may comprise a processor unit configured to direct the operation of one or more of the components of device 100. For purposes of the disclosure, the term "processor unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 106 is not limited to any specific combination of hardware circuitry and software, nor to any particular source for the instructions executed by the processing unit. In some embodiments, the controller 106 includes non-volatile memory for storing imaging device firmware. The controller firmware may comprise algorithms, such as those described herein, that are used by the controller 106 in controlling the print engine 102 and the media handling device 104.

Figure 2:
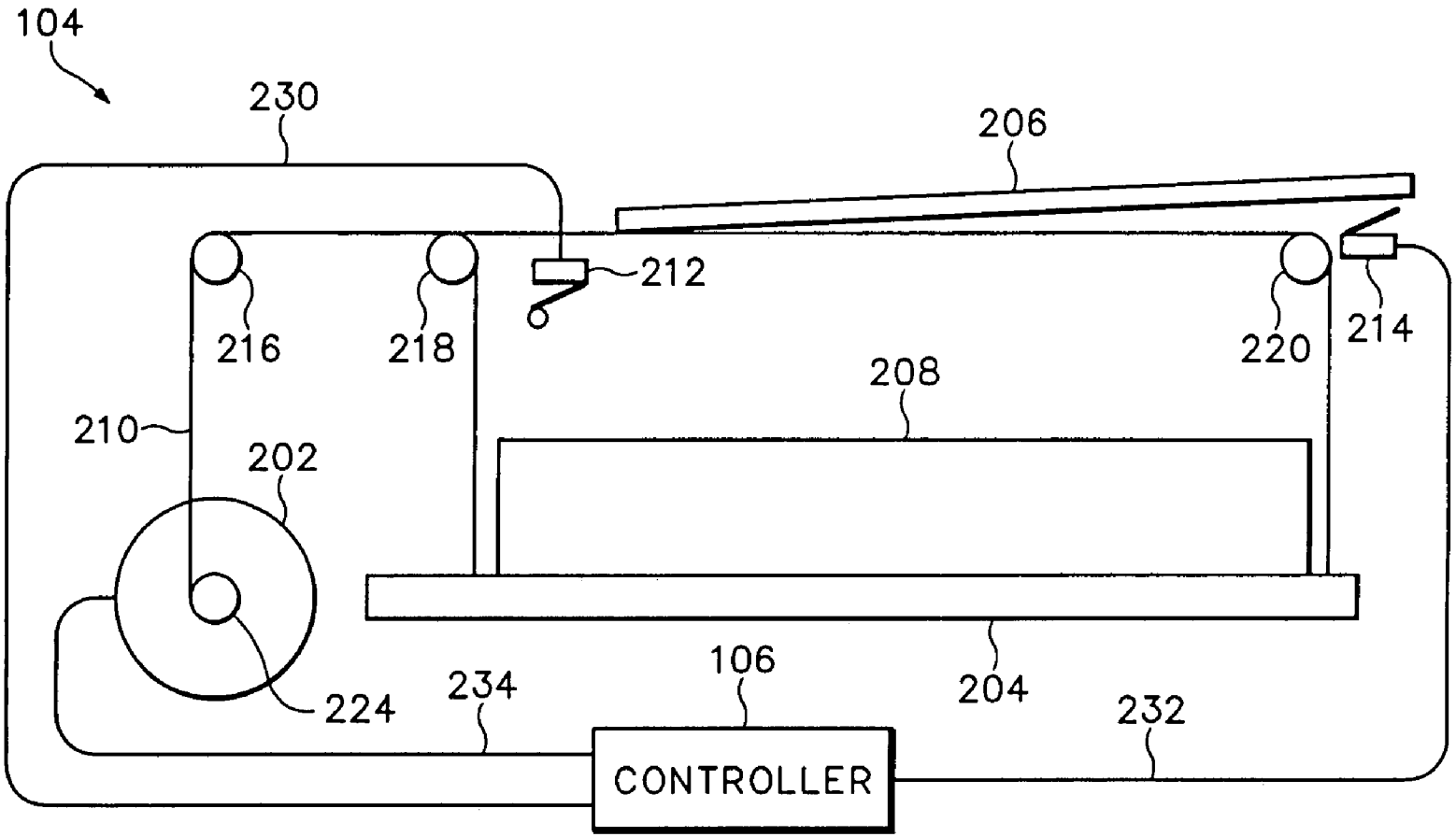
FIG. 2 is a schematic diagram of an example media handling device in accordance with an embodiment.

The media handling device 104 may be configured to include an input tray adapted to support a stack of media (FIG. 2). In some example embodiments, the controller 106 may control the media handling device 104 based on the presence of a current print job, the position of the stack of media, the position of a cover (FIG. 2) on the media handling device, or a combination of these.

FIG. 2 schematically illustrates components of an example embodiment of the media handling device 104 and controller 106. As shown, the device 104 includes a motor 202 coupled to a base 204 via cabling 210 for raising and lowering the base 204 under control of the controller 106. In one embodiment, the cabling 210 comprises multiple cables coupled to different portions of the base 204. A media stack 208 is shown as being positioned on a top surface of the base 204. A cover 206 may be provided to limit access to the media stack 208.

Sensors 212 and 214 are coupled to the controller 106. As discussed below, in some embodiments, the controller 106 drives the motor 202 based on at least one of the sensors 212, 214. The sensor 212 may comprise a media stack sensor for detecting the presence of the media stack 208 at the sensor 212, or a top surface of the media stack, at the sensor 212. The sensor 214 may comprise a cover sensor for detecting a current position of the cover 206 (i.e., open position or closed position). In some embodiments, the sensors 212, 214 comprise limit switches.

The motor 202 may comprise an AC motor, a DC motor, or other suitable motor and has an output shaft 224, around which the cabling 210 may be wound or unwound, depending on the rotational direction of the output shaft 224. In an example embodiment, the motor 202 may be a 32 volt DC motor, although different motors may be employed. The cabling 210 passes pulleys 216, 218 before connecting to one end of the base 204 and passes pulleys 216, 220 before connecting to the other end of the base 204. As such, as the output shaft 224 rotates in one direction, the cabling 210 lifts the base 204 and as the output shaft 224 rotates in an opposite direction, the cabling 210 lowers the base 204. In some embodiments, the cabling 210 comprises two cables wrapped around the output shaft 224. One of the cables extends across pulleys 216, 218 and connects at the left-hand side of the base 204 as shown in FIG. 2. The other of the cables extends across pulleys 216, 218, 220, and connects at the right-hand side of the base 204 as shown in FIG. 2.

The controller 106 receives control signals from the sensors 212 and 214 via data conduits 230, 232, respectively. The controller 106 sends control signals, power, or both, via conduit 234.

Figure 3:
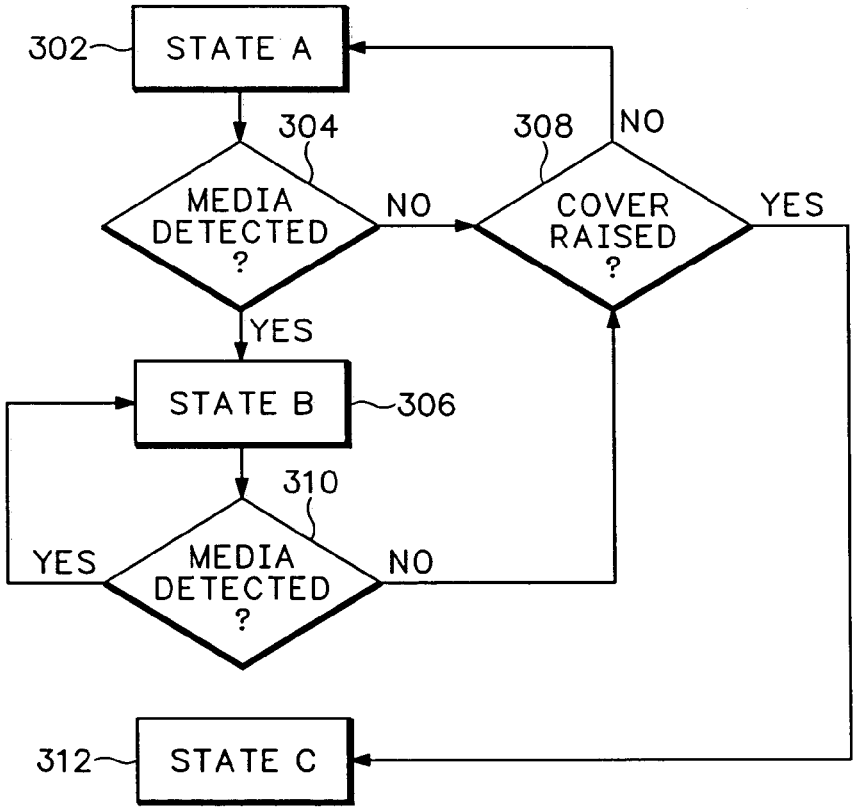
FIG. 3 is a flowchart illustrating a method in accordance with an example embodiment.

FIG. 3 is a flowchart illustrating an example embodiment of controlling the device 104. As shown in FIG. 3, the method may commence with the device 104 being in state A 302. In state A, one or more of the following may occur: the controller 106 may cause power to be transmitted to the motor at a first duty cycle, the motor 202 may apply a first torque to the shaft 224, and the base 204 raises toward the sensor 212. In some embodiments, the first torque may be approximately an amount of torque sufficient to lift the heaviest expected load on the base 204. The magnitude of the first torque, may, however, vary from one configuration to another. Consequently, in this embodiment, when the device is in state A 302, the base 204 is moving toward the sensor 212.

Next, at block 304, the controller 106 determines whether media is detected at the sensor 212. If media is detected at the sensor 212, execution proceeds to block 306, else execution proceeds to block 308. That is, if media is detected at the sensor 212, the base 204 is at a height sufficient for a top sheet of media of the stack of media 208 to be picked by a pick arm (not shown) or other suitable picking device. Hence, in some embodiments, the sensor 212 is positioned such that the sensor 212 detects media when the top sheet of media of the stack 208 is within a range of the pick arm. In particular embodiments, the sensor 212 may be positioned such that the sensor 212 detects the top sheet of the stack 208 when the top sheet is approximately in the middle of the pick arm range. The location of the sensor 212 may, however, vary from configuration to configuration and is not limited to those locations specifically described herein.

As mentioned above, if at block 304, media is not detected at the sensor 212, execution proceeds to block 308, wherein the controller 106 determines whether the cover 206 is raised based on the sensor 214. If the controller 106 determines that the cover 206 is raised, execution proceeds to block 312, else execution returns to state a 302. Hence, if the media is not detected at the sensor 212 and the cover is not raised, the device continues to operate in state A.

If, however, media is detected at the sensor 212 pursuant to block 304, execution proceeds to state B 306. In state B, one or more of the following may occur: the controller 106 may cause power to be transmitted to the motor at a second duty cycle, the motor 202 may apply a second torque to the shaft 224, and the base 204 maintains the stack at its current position or moves slowly away from the sensor 212. Here, the second duty cycle may be less than the first duty cycle and the second torque may be less than the first torque.

Next, at block 310, the controller 106 determines whether media is detected at the sensor 212. If media is detected at the sensor 212, execution returns to block 306, else execution proceeds to block 308. Hence, the device 104 may remain in state B 306 until the controller 106 determines that media is no longer present at the sensor 212. In some embodiments, media is picked from the stack 208 during state B 306.

If media is not detected at the sensor 212 at either of blocks 304, 310, execution proceeds to block 308. At block 308 the controller 106 determines whether the cover 206 is raised based on the sensor 214. If the controller 106 determines that the cover is raised at block 308 execution proceeds to state C 312. In state C, one or more of the following may occur: the controller 106 may cause power to be transmitted to the motor at a third duty cycle, the motor 202 may apply a third torque to the shaft 224, and the base 204 lowers or moves slowly away from the sensor 212. The third duty cycle may be less than the first and second duty cycles. The third duty cycle may be zero or negative. Likewise, the third torque may be lower than the first and the second torques. The third torque may be zero or in a rotational direction opposite the first and second torques. Thus, pursuant to the embodiment of FIG. 3, the base 204 lowers when the cover 206 is raised.

Figure 4:
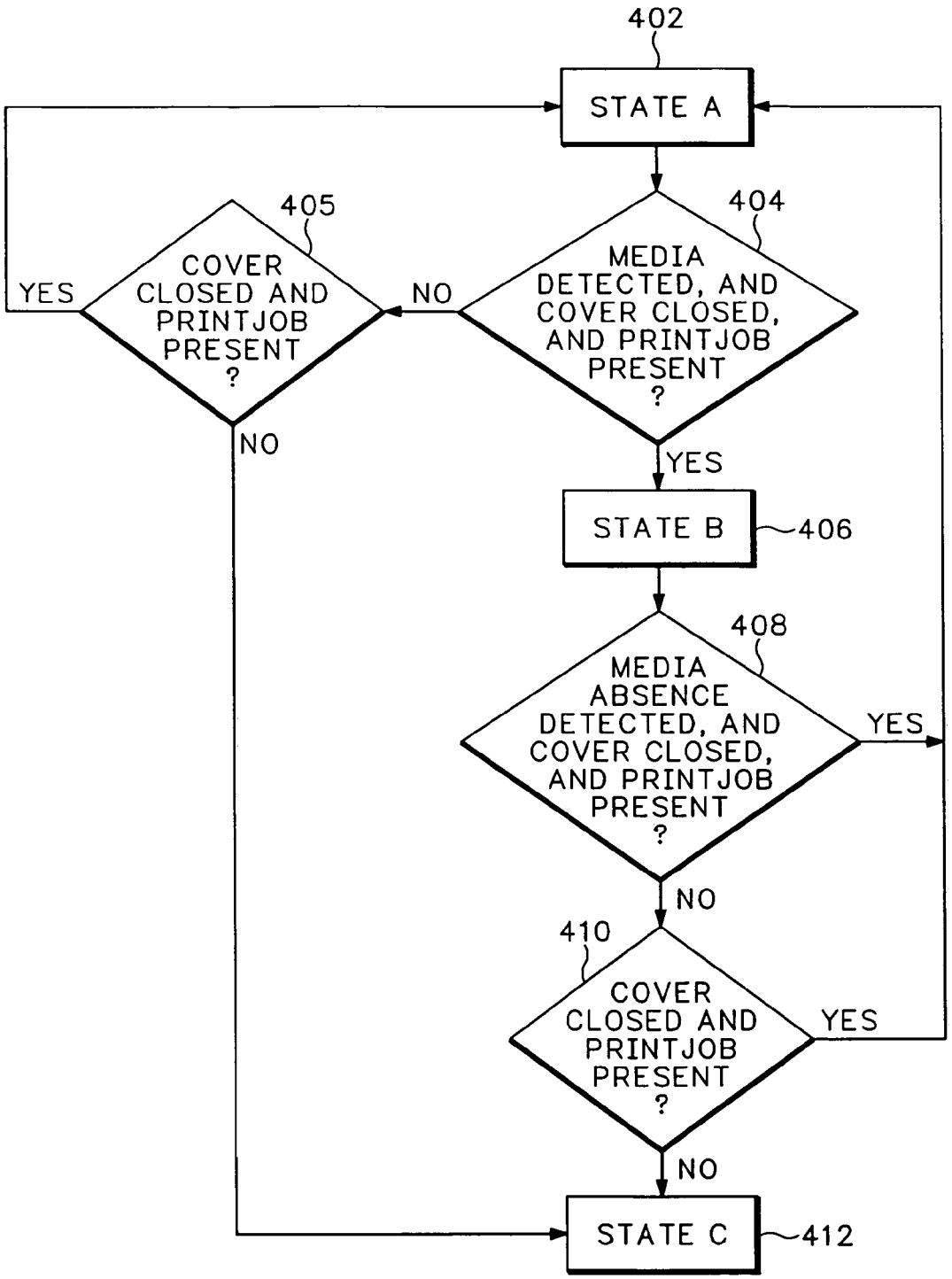
FIG. 4 is a flowchart illustrating a method in accordance with an example embodiment.

FIG. 4 is a flowchart illustrating another embodiment of controlling the device 104. As shown in FIG. 3, the method may commence with the device 104 being in state A 402. In state A, one or more of the following may occur: the controller 106 may cause power to be transmitted to the motor at a first duty cycle, the motor 202 may apply a first torque to the shaft 224, and the base 204 raises toward the sensor 212. In some embodiments, the first torque may be approximately an amount of torque sufficient to lift the heaviest expected load on the base 204. The magnitude of the first torque, may, however, vary from one configuration to another. Consequently, in this embodiment, when the device is in state A 402, the base 204 is moving the base 204 toward the sensor 212.

Next, at block 404, the controller 106 determines whether media is detected at the sensor 212, whether the cover 206 is closed, and whether a print job is present. If these three conditions are present, execution proceeds to state B 406, else execution proceeds to block 405. At block 405, the controller 106 determines whether the cover 206 is closed and whether a print job is present. If the controller 106 determines that the cover 206 is closed and that a print job is present, then execution returns to state A 402. Else, execution proceeds to state C 412.

The controller 106 determines that a print job is present if the controller 106 has received a print job and the print job has not been cancelled or completed.

At block 406, the device 104 is at state B. In state B, one or more of the following may occur: the controller 106 may cause power to be transmitted to the motor at a second duty cycle, the motor 202 may apply a second torque to the shaft 224, and the base 204 maintains the stack at its current position or moves slowly away from the sensor 212. Here, the second duty cycle may be less than the first duty cycle and the second torque may be less than the first torque. Hence, the second duty cycle and second torque, in some embodiments, are of sufficient magnitude and direction to maintain the base 204 at its current position or to permit the base 204 to move slowly downward, away from the sensor 212.

Next, at block 408, the controller 106 determines whether media is at the sensor 212, whether the cover 206 is closed, and whether a print job is present. If these three conditions are satisfied, execution returns to state A 402; else execution proceeds to block 410. At block 410, the controller 106 determines whether the cover 206 is closed and whether a print job is present. If, pursuant to block 410, the cover is closed and a print job is present, execution returns to state A 402; else execution proceeds to state C 412.

In state C, one or more of the following may occur: the controller 106 may cause power to be transmitted to the motor at a third duty cycle, the motor 202 may apply a third torque to the shaft 224, and the base 204 lowers or moves slowly away from the sensor 212. The third duty cycle may be less than the first and second duty cycles. The third duty cycle may be zero or negative. Likewise, the third torque may be lower than the first and the second torques. The third torque may be zero or in a rotational direction opposite the first and second torques. Thus, pursuant to the embodiment of FIG. 4, the base 204 lowers when the cover 206 is raised.

Accordingly, in some embodiments, a method for elevating a media input tray may be employed without use of an encoder, complex gearing, or dampers. Instead, some embodiments employ a media sensor to determine the presence or absence of media in a pick zone (i.e., the zone in which a pick arm may pick a top sheet of media from a stack). Motor power, torque, or both may then be varied based on whether the media is present in the pick zone to move a media input tray in a manner to permit effective picking of media from the tray.

The foregoing description of various embodiments has been presented for purposes of illustration and description. It is not intended to be exhaustive or limiting, and modifications and variations are possible in light of the above teachings or may be acquired from practice. The embodiments were chosen and described in order to explain the principles and application to enable one skilled in the art to utilize the claimed subject matter in various embodiments and with various suitable modifications.

What is claimed is:

1. A method, comprising:

loading media onto a base through an opening over the base;

positioning a cover over the opening;

first raising the base having media thereon;

permitting the base to lower upon detecting the media;

detecting an absence of the media, wherein a limit switch sensor performs the detecting of the media;

second raising the base upon the detecting the absence of the media;

detecting a position of the cover;

detecting absence of a print job; and lowering the base based on the absence of the print job and in response to the position of the cover in a raised and opened state.

2. The method of claim 1, further comprising:

detecting presence of a print job;

wherein the second raising the base is based on the presence of the print job.

3. The method of claim 1, further comprising:

detecting presence of a print job;

detecting a position of a cover;

wherein the second raising the base is based on the presence of the print job and the position of the cover.

4. The method of claim 1, wherein the detecting the absence of the media is within a pick arm range.

* * * * *